US007086437B1

(12) United States Patent
Michael

(10) Patent No.: US 7,086,437 B1
(45) Date of Patent: Aug. 8, 2006

(54) PURSE AND METHOD FOR PURCHASING A CUSTOMIZED PURSE

(76) Inventor: Mary Jane Michael, 3281 N. Port Clinton Rd., Fremont, OH (US) 43420

( * ) Notice: Subject to any disclaimer, the term of this patent is extended or adjusted under 35 U.S.C. 154(b) by 929 days.

(21) Appl. No.: 09/685,466

(22) Filed: Oct. 10, 2000

(51) Int. Cl.
*A45C 1/02* (2006.01)

(52) U.S. Cl. ..... 150/103; 150/104; 150/105; 190/110; 383/111

(58) Field of Classification Search ..... 150/103–105, 150/113, 111; 190/108, 110; 383/111
See application file for complete search history.

(56) References Cited

U.S. PATENT DOCUMENTS

| | | | | | |
|---|---|---|---|---|---|
| 767,898 | A * | 8/1904 | Lamphier | 190/107 |
| 1,960,396 | A * | 5/1934 | Rosneberg | 150/105 |
| 2,118,323 | A * | 5/1938 | Murphy | 312/244 |
| 2,609,854 | A * | 9/1952 | Rosen | 150/124 |
| 2,723,696 | A * | 11/1955 | Kase | 150/105 |
| 2,800,353 | A * | 7/1957 | Denham et al. | 294/16 |
| 3,414,033 | A * | 12/1968 | Tucker | 150/104 |
| D253,203 | S * | 10/1979 | Hatcher | D3/238 |
| 4,263,951 | A * | 4/1981 | Siegel | 150/111 |
| 4,838,421 | A * | 6/1989 | Mastronardo | 206/387.14 |
| 4,907,633 | A * | 3/1990 | Eckstein | 150/105 |
| 4,995,436 | A * | 2/1991 | Cantor | 150/102 |
| 5,018,609 | A * | 5/1991 | Brenner | 190/108 |
| D334,661 | S * | 4/1993 | Kohn | D3/319 |
| 5,207,254 | A * | 5/1993 | Fromm | 150/104 |
| 5,207,303 | A * | 5/1993 | Oswalt et al. | 190/108 |
| 5,567,055 | A * | 10/1996 | Smith | 383/38 |
| 5,845,780 | A * | 12/1998 | Allen | 206/579 |
| 5,911,262 | A * | 6/1999 | Steinhart | 150/103 |
| 6,029,723 | A * | 2/2000 | Baquero et al. | 150/105 |
| 6,138,827 | A * | 10/2000 | Marshall | 206/373 |
| 6,179,025 | B1 * | 1/2001 | Sutton | 150/105 |
| 6,186,201 | B1 * | 2/2001 | Salz | 150/105 |
| 6,210,037 | B1 * | 4/2001 | Brandon, Jr. | 383/111 |
| 6,244,400 | B1 * | 6/2001 | Bowers | 190/110 |

FOREIGN PATENT DOCUMENTS

| | | | | |
|---|---|---|---|---|
| DE | 19711747 | A1 * | 9/1998 | |
| EP | 0428451 | A1 * | 5/1991 | 150/113 |
| FR | 2577773 | A3 * | 8/1986 | |
| FR | 2653312 | A3 * | 4/1991 | |
| WO | WO93/07777 | * | 4/1993 | 150/105 |
| WO | WO93/21793 | * | 11/1993 | |

* cited by examiner

*Primary Examiner*—Sue A. Weaver
(74) *Attorney, Agent, or Firm*—Jerry Semer

(57) ABSTRACT

The present invention relates to a method for sale of a custom made purse through a kiosk or Internet system. On computer screens, an individual purchases a purse and chooses the options, the size, the color, the fabric and everything necessary for the making of a custom made purse. This information is then electronically sent to the web company where the purse is prepared and shipped to the individual. The purse involved has been specially designed so that it can be customized; however, the purse is standard enough that it can be produced cheaply. The features that enable this are a releasable liner and releasably attached pouches on the outside and inside of the purse. This liner is attached to the purse by snaps or hock and loop fabric. The liner has several sides on which different types of pouches can be attached with snaps or hock and loop fabrics. This enables the inside of the purse to be customized with may different pouches. The liner is attached to the purse with snaps and thus can be removed and placed in another purse. Pouches can be attached to the outside of the purse with snaps.

7 Claims, 17 Drawing Sheets

{screen #1}

WELCOME TO:

Draw
Example of
3 Women

YOUR'RE IN CHARGE ~ _____
Your Name

SOLUTIONS FOR YOUR LIFESTYLE

SPEEDY PURSE CHANGES DUE TO TRANSFERABLE LINER

Draw
Messy display
of purse items

"STUFF ORGANIZATION DESIGNED BY YOU

SIMPLE SELECTION INSTRUCTIONS:

PERSONALIZE

PIC

PURCHASE

Personal Use

Gift for Others
Gift Certificate
{Double Click for Certificate}

1) Change your mind as much as you like until you've chosen the perfect purse for you
2) Prices vary due to choices ~ $__7___ +handling & tax where required ~ must be over 18 to order.
   Available to ship to U.S. & Canada ~ All prices listed are without tax & handling
3) Each purse requires a separate order Continue

FIG. 1

[screen #2]

Draw Purse Logo Let's Have Fun,_____(clients name)

PERSONALIZE

#1. Select style ~ (pick one)

click A. Executive ~ 15" X 12" X 7" deep draw picture of bag click B. Classic ~ 13" X 10" X7" deep draw picture of bag click C. Low Maintenance ~ 9" X 7" X 4" deep draw picture

BACK continue

FIG. 1A (screen #3)

PIC:

| #1 | Select Exterior Fabrication (pick one) | | Executive | Classic | Low Maintenance |
|---|---|---|---|---|---|
| | Lightweight Leather | basic cost | $_____ | $_____ | $_____ |
| | Vinyl | basic cost | $_____ | $_____ | $_____ |
| | Cloth | basic cost | $_____ | $_____ | $_____ |

| #2 | Select handle (choose any or all | | | | |
|---|---|---|---|---|---|
| | 20" Short | $_____ | $_____ | $_____ | Draw 3 bags with |
| | 30" Mid-size | $_____ | $_____ | $_____ | short, mid-size & |
| | 48" Shoulder-length (adjustable type) | $_____ | $_____ | $_____ | shoulder-length handles showing buckle |

| #3 | Select Color Choice | | | |
|---|---|---|---|---|
| | Black | $_____ | $_____ | $_____ |
| | Navy | $_____ | $_____ | $_____ |
| | Cordovan | $_____ | $_____ | $_____ |
| | Camel | $_____ | $_____ | $_____ |
| | White | $_____ | $_____ | $_____ |
| | Jean Fabric | $_____ | $_____ | $_____ |
| | Tread Color #1 | $_____ | $_____ | $_____ |

BACK continue

FIG. 1B

[screen 4]

PIC EXTERIOR COMPARTMENT SELECTIONS!
(EXTERIOR SNAPS COME WITH SNAP COVERS SHOULD YOU WANT TO REMOVE THE EXTERIOR PPURCHES)

1. GLASSES CASE to match exterior for placement in exterior glasses pouch made of exterior fabric

(Draw purse angle with pouch and glasses case)

Cost (based on your exterior choice)

Leather $_____ Vinyl $_____ Cloth $_____

Select___ Cancel __

2. SUN GLASSES COMPARTMENT

(draw purse angle with pouch and glasses case)

Cost (based on your exterior choice)

Leather $_____ Vinyl $_____ Cloth $_____

Select__ Cancel__

3. FILE FOLDER
(only applicable for Executive and Classic purses, not Low Maintenance)

(draw purse angle with pouch and file folder)

Cost (based on your exterior choice)

Leather $_____ Vinyl $_____ Cloth $_____

Select__ Cancel__

FIG. 1C

BACK continue

[screen 4 continued]

7. COIN HOLDER - matching exterior fabric to fit into existing exterior coin pouch only applicable for executive and classic purses not Low -Maintenance)
(draw purse angle with coin holder)

Cost (based on your exterior choice)

Leather $_____ Vinyl $_____ Cloth $_____

Select__ Cancel__

All purses include with no charge:

1. cell phone holder
2. water bottle holder
3. key pouch holder

These are exterior pouches of matching exterior fabric

FIG 1D

BACK continue

[screen 4 continued]

4. DAY-PLANNER
(only applicable for executive and classic purses not Low -Maintenance)
(draw purse angle with pouch and Day-Planner

*Cost (based on your exterior choice)*

Leather $_____ Vinyl $_____ Cloth $_____

Select__ Cancel__

5. RECEIPT CARRIER

(only applicable for executive and classic purses not Low -Maintenance)
(draw purse angle with pouch and Receipt carrier)

*Cost (based on your exterior choice)*

Leather $_____ Vinyl $_____ Cloth $_____

Select__ Cancel__

6. PASSPORT, TICKET,MAIL AND STAMP CARRIER only applicable for executive and classic purses not Low -Maintenance)
(draw purse angle with passport ,ticket, mail and stamp carrier)

Cost (based on your exterior choice)

Leather $_____ Vinyl $_____ Cloth $_____

Select__ Cancel__

FIG. 1E

BACK continue

[screen 6]

GOOD JOB_____!!
Name show finished exterior

Are you satisfied? Yes____ No____

[if not, click back to the beginning & just start over]

If satisfied, click to interior compartment choices.

FIG. 1F

BACK continue

[screen 8]

PIC ~ YOUR TRANSFERABLE LINER COMPARTMENTS

Draw picture of purse liner in 3-D to show removable liner which is attached with heavy snaps on 4 sides; it has 8 sides to attach compartments Interior Selections ~

Made of "tough" nylon anchored with velcro

Exterior selections made of "same" purse fabric and snapped to front

Constructed to accommodate your personal compartment selections

Click one: Executive

Classic

Low-Maintanance

FIG. 2

BACK continue

[screen 7]

PIC INTERIOR COMPARTMENTS
(all interior pouches are made of a lightweight nylon)

Compartment options:

1. Glasses $_____ select_____ cancel____
(closure will be spring)
(draw picture)

2. Sun Glasses $_____ select____ cancel____
(draw picture)

3. Check Book $_____ select_____ cancel____
(draw picture)

4. Make Up $_____ select____ cancel____
(draw picture)

5. Currency $_____ select____ cancel____
(draw picture)

6. Receipts $_____ select____ cancel____
(draw picture)

7. Keys $_____ select____ cancel____
(draw picture)

8. Medicine $_____ select ____ cancel____
(draw picture)

9. 7 Day Medicine Container $_____ select____ cancel____
(draw picture)

BACK

FIG. 2A continue

[screen 8]

10. Medicine $_____ select___ cancel___
(draw picture)

11. Pen/Pencil $_____ select___ cancel___
(draw picture)

12. Brush, Comb, Pick $_____ select___ cancel___
(draw picture)

13. Propane Curling Iron $_____ select___ cancel___
(draw picture)

14. Kleenex $_____ select___ cancel___
(draw picture)

15. Envelopes/Stamps $_____ select___ cancel___
(draw picture)

16. Address Book $_____ select___ cancel___
(draw picture)

17. Driver's license $_____ select___ cancel___
(draw picture)

18. Credit Card Holder $_____ select___ cancel___
(draw picture)

19. Personal Hygiene $_____ select___ cancel___
(draw picture)

20. Cell Phone $_____ select___ cancel___
(draw picture)

If all interior choices have been made click to see a view of your finished interior liner._____
click BACK continue

FIG. 2B

[screen 9]

INTERIOR COMPONENTS ON COMPLETED LINER

Draw 8 walls of choices 15" X 12" X 7"

#1 For Executive ~ space available:

wall #1 wall#5 wall #2 wall #6 wall #3 wall #7 wall #4 wall #8

BACK continue

FIG. 2C

[screen 10]

INTERIOR WALLS CONTINUED...

Draw 8 walls completed

#2 FOR CLASSIC ~ Space available:

wall #1 wall#5 wall #2 wall #6 wall #3 wall #7 wall #4 wall #8

BACK continue

FIG. 2D

{screen 11}

INTERIOR COMPONENTS CONTINUED...

Draw 4 walls no ends 9" X 7" X 4"

#3 Low Maintenance ~ space available wall #1 wall #4 wall #2 wall #5 wall #3 wall #6

FIG. 2E

BACK continue

PURSE AND METHOD FOR PURCHASING A CUSTOMIZED PURSE

FIELD OF THE INVENTION

The present invention relates to a purse and a method to purchase a purse particularly, a method to purchase a customized purse electronically.

BACKGROUND OF THE INVENTION

Although purses come in a great number of different sizes and shapes, no one purse fits an individual. Usually when a woman is picking out the purse, she can find a purse with some of the items she wants and maybe even the proper size, but not all of them. Thus, one of the objectives of this invention is for the individual herself to create the purse that meets her specification. Clearly, every woman has different specifications for purses. Some like them large, others like them small. The person who wears glasses may wish for a glass case. Other individuals may want check books or coin purses. A professional woman may want a calendar pocket within her purse. Some women would want a make-up pouch while others would want a pouch to carry receipts from a business trip. A woman who travels a lot would like a pouch inside that carries airline tickets and travel information. Some would need a pocket for their jewelry. Others would need a pocket to carry a curling iron. Some may even need a pocket for file folders. An international traveler may want a pocket to carry a passport. Others who use that purse on walks may want a water bottle pouch within the pocket. Almost everyone needs a credit card holder and a driver's license holder. However, these holders can become many shapes according to the wants and needs of the individual. Also women wear purses in different ways. Some like to carry them by the strap, in their hand, others like to place them over the shoulder. These types of handles are placed on the outside with buckles.

The problem in the industry as to creating a custom purse has always been the cost. Applicant has designed a purse that can be customized easily and economically. One of the objectives of this invention is to create a large number of options which a woman can choose from to pick a purse that meets her needs. The feature that obtains this objective is a releasably attachable liner and numerous pouches that attach to the liner. Another feature that obtains this objective is that a woman, ordering the purse, does it over an electronic network. The ordering of the purse is sent directly to the web company so that she can get her purse custom made.

SUMMARY OF THE INVENTION

The present invention relates to a method for sale of a custom made purse through a kiosk or Internet system. On computer screens, an individual purchases a purse and chooses the options, the size, the color, the fabric and everything necessary for the making of a custom made purse. This information is then electronically sent to the web company where the purse is prepared and shipped to the individual. The purse involved has been specially designed so that it can be customized; however, the purse is standard enough that it can be produced cheaply. The features that enables this are the releasable liner and the releasable pouches. This liner is attached to the purse by snaps or hock and loop fabric. The liner has several sides on which different types of pouches can be attached with snaps or hock and loop fabrics. This enables the inside of the purse to be customized with may different pouches. The outside of the purse can also be customized. Different pouches can be added3 or removed from the outside of the purse. These pouches are attached with snaps. The liner is attached to the purse with snaps and thus can be removed and placed in another purse. The choices for the pouches are as follows: key holder, coin holder, glasses case, sun glasses case, check book pouch, airline ticket pouch, passport pouch, make-up pouch, currency carrier, receipt carrier, medicine pouch, pen/pencil holder, a brush holder, comb holder, pick holder, a holder for a propane curling iron, tissue compartment, a jewelry pouch, an envelope and stamp pouch, an address book holder, a calendar holder, a driver's license holder, credit card holder, personal business card holder, and a personal hygiene carrier.

BRIEF DESCRIPTION OF THE DRAWINGS

FIG. 1 is a computer screen for introducing the purse.

FIG. 1A is a computer screen for choosing the style of the purse.

FIG. 1B is a computer screen for choosing the color, fabric, and handle for the purse.

FIG. 1C is a computer screen for choosing the exterior components of the purse.

FIG. 1D is another computer screen for choosing exterior components of the purse.

FIG. 1E is another computer screen for choosing the exterior components for the purse.

FIG. 1F is another computer screen for the choice of exterior components for the purse FIG. 2 is a computer screen introducing the transferable liner.

FIG. 2A is a computer screen for choosing the interior components for the purse.

FIG. 2B is a computer screen for choosing the interior components for the purse.

FIG. 2C is a computer screen showing where the interior components are placed.

FIG. 2D is another computer screen showing where the interior components are placed.

FIG. 2E is another computer screen showing where the interior components are placed.

DETAILED DESCRIPTION OF THE PREFERRED EMBODIMENT

Figure 3:
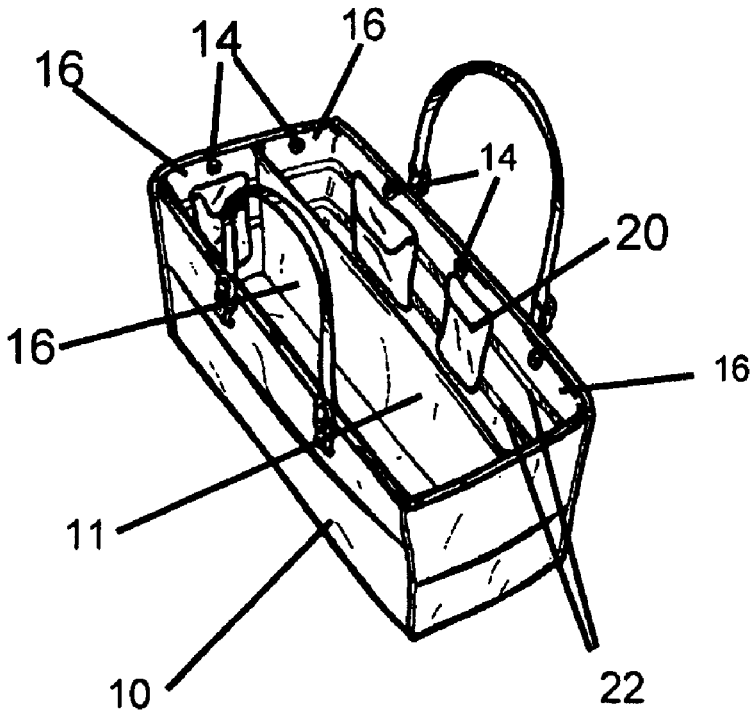
FIG. 3 is a perspective drawing of the transferable liner.

The newly designed purse can be sold through either a kiosk or a common, ordinary, everyday personal computer. These devices are hooked to a modem or a network, and thus the purse is purchased over the Internet. A series of screens is flashed on both of these sale devices and an individual picks and chooses the options in which they wish. In the case of the kiosk, the interface would probably be done by a touch screen. In the case of the personal computer, the person would choose their options through the use of the mouse or keyboard. After once logging onto the system at either the kiosk or a computer, a screen similar to the one shown in FIG. 1, pops up introducing the product and in the preferred embodiment gets the individuals name.

The next set of screens in the preferred embodiment shows options as to the size, shape and style of the purse. This screen allows numerous options as to the size and shape of the purse. This screen would look similar to the one shown in FIG. 1A. Each of these options would be pictorially represented. These representations could be in 3D. As soon as the size and shape is picked, a small screen within the larger one could give the individual a pictorial of what the purse would look like as to the options already picked. This representation could also be in 3D and could rotate to show all sides of the purse. Once all the choices on one screen are made the next screen would jump into place. On this set of screens one would pick the shape of the main body of the purse. As soon as the shape is picked, a small screen within the larger one would give the individual a pictorial of what the purse would look like as to the options already picked. Once the shape is picked the next screen would show the different options to the exterior of the purse. The next screen similar to one shown in FIG. 1B would allow the choosing of the exterior color and the exterior fabrication of the purse. One could try out different colors and different fabrications on the small pictorial of the purse being built. The next item as to the exterior portion of the purse would be the handle options. This is also on screen 1B. One could choose from a long, medium or short shoulder strap. There also may be several different types of handles which one could choose for the purse. These too could be represented in the small screen for the individual to see exactly what they would be receiving and to try out the options.

The next set of screens FIGS. 1C, 1D, and 1E could deal with exterior compartments. These options shown in FIG. 4 could include a glasses case 54, sun glasses case 56, a file folder compartment 100, address book holder 88, a calendar holder or day-timer 90, receipt carrier 68, envelope and stamp carrier 86, water bottle carrier 102, key pouch 50, coin holder 52, cell phone holder 104, airline ticket holder 60, passport holder 62. These compartments can be placed on the outside of the purse; however in upcoming screen on can choose these compartment for the inside of the purse. These compartments would be attached to the purse with snaps in the preferred embodiment. The snaps on the purse can also be covered with matching snap covers 110 when the exterior compartments are not in use. The exterior attachment of the compartments has a large advantage for the user. One could choose a glasses case 54 which would fit within the purse for a person to place their glasses within the purse. This glasses case could also be attached to the outside purse for easy access. This would be an especially popular item for the over forty set who need reading glasses. The pouch could also be placed on the end of the purse or the side of the purse. All these options could be shown on the screen. As pointed out above, a person could place the pouch in the location of her choice on the screen showing her purse. Thus she could try several options and see which one he liked.

Of course different people would want different choices and different pouches. A professional woman may want a calendar or day timer pouch 90. These pouches could be large or small according to the size of their calendar or day timer. This would enable easy access to her calendar for making appointments since it would be on the outside of the purse. A person who travels may want a pouch for airline tickets 60 or a passport holder 62 on the outside of their purse for easy access. A business traveler may want a receipt carrier 68 to place receipts from their travels. A person who has to walk or has small children may want a water bottle carrier 102. The individual will, through a set of screens similar to 1C, 1D, and 1E, make her choice for the pouches she would want on the outside of her purse.

The next set of screens would deal with the interior of the purse. One could choose the material, fabrication and color of the inter liner. These liners would be designed for the different choices of exterior style, shape and size. The liner would be interchangeable with purses of similar size, shape, and style. FIG. 2 shows a screen that could introduce the liner to the purchaser.

Figure 4:
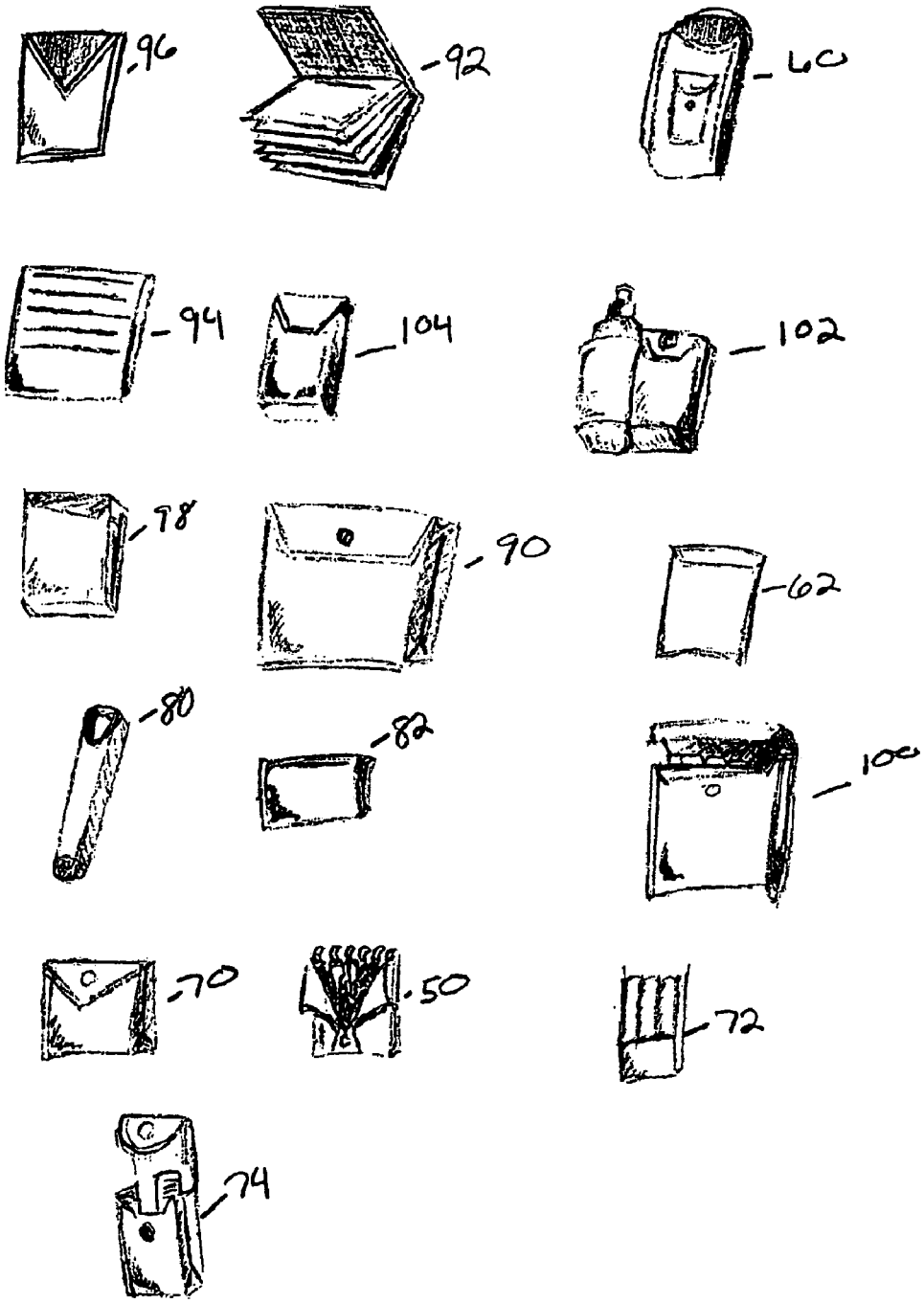
FIG. 4 is drawings of the interior and exterior pouches for the purse.

FIG. 3 shows the liner 12 of the preferred embodiment. The liner 12 in the preferred embodiment attaches with snaps 14 to the interior sides of the purse 10. The liner 12 also could be attached with hook and loop fabric or by other methods known in the art. The liner 12 in the preferred embodiment is a rectangular container with an open top. Though the middle of the rectangular container is a partition 11. This enables the liner 12 of the preferred embodiment to have eight sides 16 to attach pouches 20. Liners 12 could also be designed with fewer or more sides. In the preferred embodiment the liner 12 is made of heavy nylon. The individual would choose the number of pouches 20 they would want inside the purse and the color and fabrication and material of the inner purse through a set of screens. As in the previous screens, one would have the small screen that would show the liner 12 and the inside of the purse 10 from different perspectives and in 3D so that an informed choice can be made. In this next set of screens, one would choose different pooches 20 that they would want in the purse 10. These pouches could be designed to fit on the inside of the purse 10 or as already pointed out on the outside or both. FIG. 4 shows the different choices of internal items. These are key holder 50, coin holder 52, glasses case 54, sun glasses case 56, check book pouch 58, airline ticket pouch 60, passport pouch 62, make-up pouch 64, currency carrier 66, receipt carrier 68, medicine pouch 70, pen/pencil holder 72, a brush holder 74, comb holder 76, pick holder 76, a holder for a propane curling iron 80, tissue compartment 82, a jewelry pouch 84, an envelope and stamp pouch 86, an address book holder 88, a calendar holder 90, a driver's license holder 92, credit card holder 94, personal business card holder 96, and a personal hygiene carrier 98. Possible screens for these option are shown in FIGS. 2A, 2B, and 2C.

These pouches could be designed in different sizes. This would be especially true of the make-up pouch 64. Some individuals may like to carry large make-up pouches 64 within their purse. Some may like smaller ones. The make-up pouch 64 could also be set on the inside or outside of the purse 10. Another pouch could be a receipt carrier 68 which has several different compartments within the pouch. The receipt carrier 68 is designed to carry your receipts. A professional person traveling would place different receipts in different pouches to represent different items. Another pouch that could be placed in the purse 10 would be a key holder 50. There could be many different varieties of key holders from just a snap to snap your keys on to a pouch in which you actually place your keys. A medicine pouch 70 could also be within the purse 10. A pencil holder or pen holder 72 could also be placed within the purse for individuals who do writing. These pouches could also be placed on the outside of the purse 10. There could be pouches for propane curling irons 80, tissue holder 82, also several different pouches for jewelry or maybe even a jewelry draw string pouch. An individual may want a pouch for an address book 88 or an envelope and stamp pouch 86, pouches for a water bottle 102 and snacks or a miscellaneous set of pouches. Also, one could choose a credit card holder 94. This holder could be designed to hold not only credit cards but also, driver's license. It could be done by a set of clear plastic envelopes or by a set of slots. A person may also want pouches to carry their passport 62 or maybe business cards 96. All these options could be chosen in different screens. As the purse 10 is being built, it will show in the small screen the different options chosen. The small screen would not only show the outer portion of the purse 10 but also the inside where the individual could see exactly how their purse 10 is being built. A small screen could also show the purse 10 from several different perspectives. Along with the small screen would be screens showing the space available on each of the walls 18 of the transferable liner 12. This is shown in FIGS. 4A, 4B, and 4C. Above ones choices in these figures are the walls 20 of the liner 12. When an optional pouch 20 is choose, the individual then could position the pouch on the wall of the liner of her choice. The pouch 20 chosen would than be drawn on the liner walls 18 at the point. Thus an individual would know how the purse 10 looks on the inside and out but also how much more space is available for additional pouches 20.

In the preferred embodiment the pouches 20 are hooked to the liner 12 by hook and loop fabric 22. However there are many methods known in the art to attach the pouches 20 to the liner 12.

Figure 5:
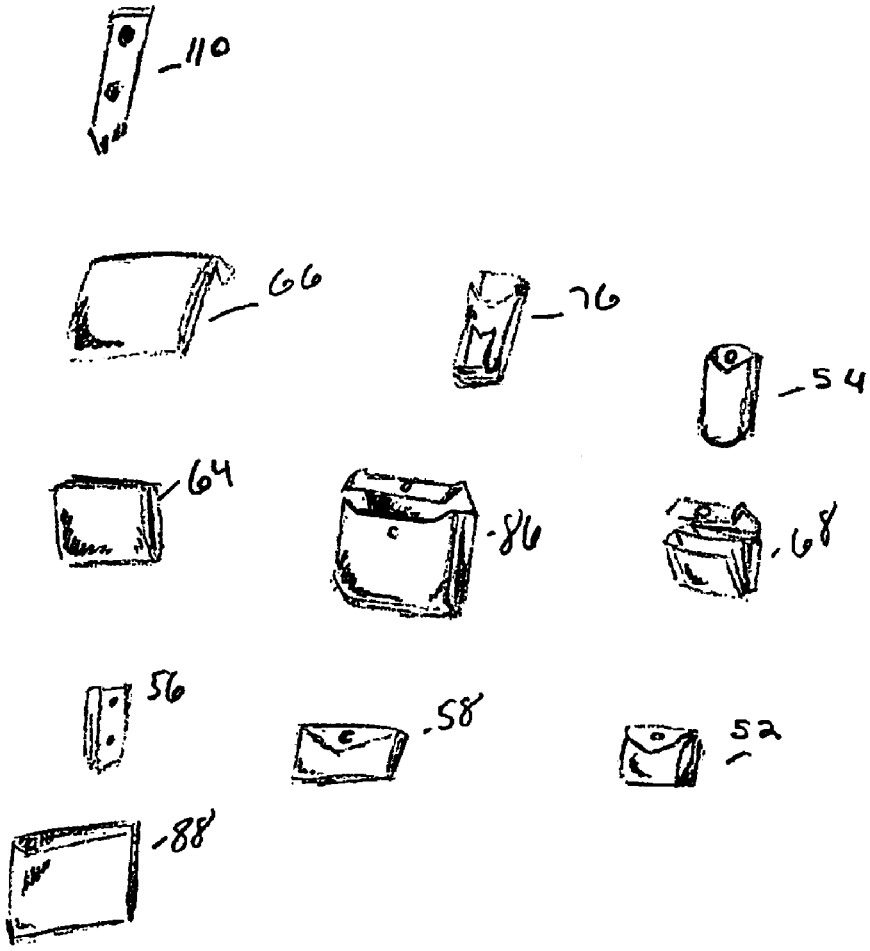
FIG. 5 is drawings of more of the interior and exterior pouches for the purse.
Figure 6:
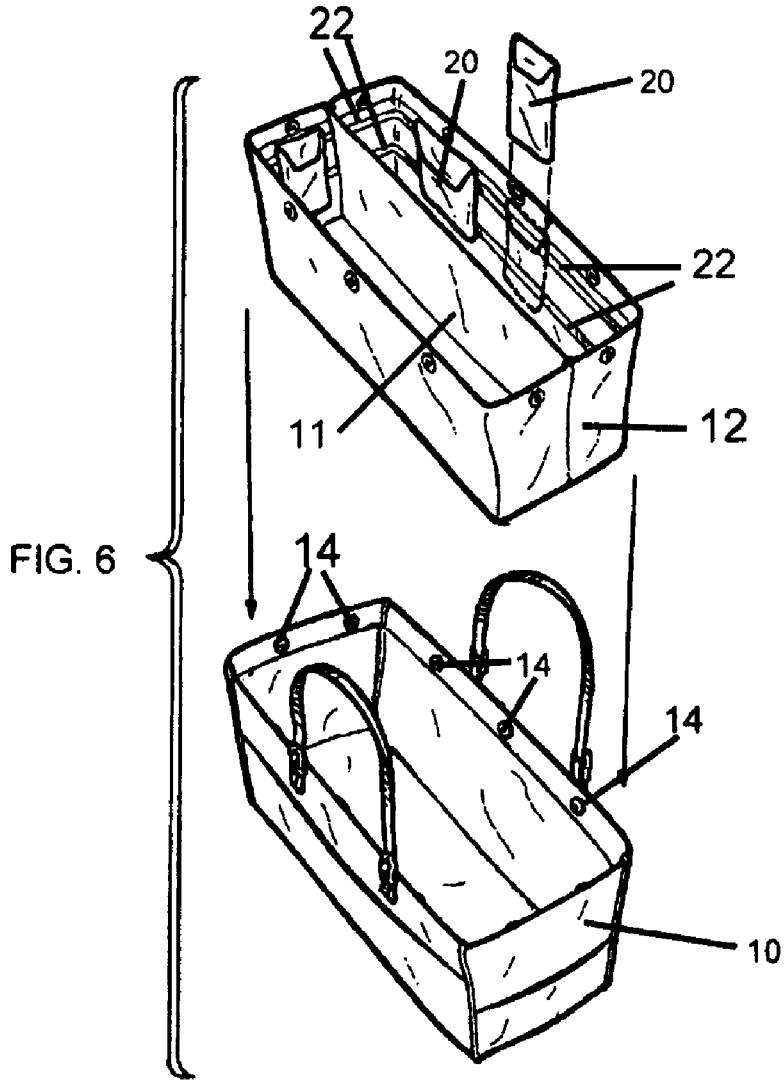
FIG. 6 is an exploded view of the purse with transferable liner and pouches.

The system has been designed for easy manufacturing. However the system allows great individualization. This is done through the use of the releasable attached liner 12. The liner 12 shown in FIG. 5 is basically a set of sides that attach to the purse 10 with snaps. This gives the liner 12 the ability to be used in several purses of the same size. The liner 12 has hook and loop fabric 22 on the sides. This allows the different pouches 20 which the individual wishes to have in her purse 10 to attach to the liner 12. The pouches 20 also have hook and loop fabric 22 so that they can be easily attached to the liner 12. Also most of the pouches 20 that go on the exterior of the purse 10 are of same size and could be construction as the pouches on the interior of the purse 10. The only difference is that the pouches 21 on the inside hook to the liner 12 with hook and loop fabric and the pouches 20 on the exterior hook with snaps to the purse 10. In the preferred embodiment the interior pouches are made out of nylon to match the liner 12. The purse 10 can be offered in several styles, like with three handles, and in several colors, and several fabrics. However as long the purse 10 has a similar inter dimension the same size liner 12 can be used. Further the individual can choose from several different pouches for the inside of the purse. These all attach with hook and loop fabric 22 to the liner 12. Thus the purse 10 can come with numerous inside configurations using the same liner 12. Thus the purse 10 can be individualized and yet be easy to manufacture in that the components that make the insides of the purse 10 all attach with hook and loop fabric. Further the liner 12 can be moved from one purse 10 to a similar size purse 10 without one having to move each item in the purse 10 separately.

Changes and modifications in the specifically described embodiments can be carried out without departing from the scope of the invention which is intended to be limited only by the scope of the appending claims.

I claim:

1. A purse system which allows individuals to chose the accessory organizers and design their own purse and still allow for the purse to be economically mass produced comprising:

a. two or more purses each with a different style or color with an inside and an outside and an opening in the top; and, b. a removable container designed to hold items with at least four sides and a bottom that form an enclosed structure and that enclosed structure has inner and outer sides and can be opened at the top and said container is adapted in size such that it can be easily placed within the different purses and easily removed form the different purses even when containing items; and, c. a plurality of inner pouches designed to hold specific accessories; and, d. a first attachment means upon the inner pouches and a cooperating attachment means on the inner sides of three or more of the inner sides of the removable container allowing for the inner pouches to be releasably attached to the inner sides to the removable container and each inner pouches can be attached at many different position along the inner sides of the removable container and allows an individual to design and organize the placement of each pouch and said inner pouches can be selectively interchanged, thus allowing an individual to select the type and placement of each pouch with in the removable container and to be able to change the placement and type of pouches used at any time; and, e. the inner pouches are chosen from a group of inner pouches that include inner pouches designed for business cards, driver's license, coins, make-up, wallet, or credit card, key holder, pen/pencil holder, glass case, checkbook, medicine, brush, comb, address book holder, calendar holder, jewelry, a water bottle, personal hygiene carrier, tissues, airline ticket pouch, receipt holder, pick holder, propane curling iron holder, tissue holder, or passport.

2. A purse system as in claim 1 further comprising:

a. outer pouches designed to hold items; and, b. a means to releasably attach the outer pouches to the outside of the purses.

3. A purse system as in claim 2 wherein:

a. the means for attaching the outer pouches to the purses is a set of snaps.

4. A purse system as in claim 1 wherein:

a. the first attachment means and cooperating attachment means is a set of snaps.

5. A purse system as in claim 1 wherein:

a. the first attachment means cooperating attachment means is hook and loop fabric on both the container and the inner pouches.

6. A purse system as in claim 1 further comprising:

a. the container has more than four inner sides.

7. A purse system as in claim 1 further comprising:

a. a handle chosen from a set of handles and shoulder straps.

* * * * *